US007191577B2

(12) United States Patent
Tamis

(10) Patent No.: US 7,191,577 B2
(45) Date of Patent: Mar. 20, 2007

(54) METHOD FOR PROVIDING A HEAT TREATED FILLED AND CLOSED METAL CAN

(75) Inventor: Paulus Jozef Tamis, LK Velserbroek (NL)

(73) Assignee: Corus Staal BV, Ijmuiden (NL)

( * ) Notice: Subject to any disclaimer, the term of this patent is extended or adjusted under 35 U.S.C. 154(b) by 45 days.

(21) Appl. No.: 10/518,578

(22) PCT Filed: Jun. 27, 2003

(86) PCT No.: PCT/EP03/06903

§ 371 (c)(1),
(2), (4) Date: Dec. 21, 2004

(87) PCT Pub. No.: WO2004/002832

PCT Pub. Date: Jan. 8, 2004

(65) Prior Publication Data

US 2005/0210835 A1 Sep. 29, 2005

(30) Foreign Application Priority Data

Jun. 28, 2002 (EP) ..... 02077594

(51) Int. Cl.
*B65B 55/02* (2006.01)
*B65B 7/28* (2006.01)

(52) U.S. Cl. ..... 53/425; 53/432; 53/469; 53/471; 426/393; 426/401; 426/407; 426/412

(58) Field of Classification Search ..... 53/425, 53/428, 431–434, 440, 469, 471, 485; 220/359.1, 220/359.2, 359.4; 426/407–409, 401, 404, 426/412, 393
See application file for complete search history.

(56) References Cited

U.S. PATENT DOCUMENTS 2,634,563 A * 4/1953 Magill et al. ..... 53/452

(Continued)

FOREIGN PATENT DOCUMENTS

DE 4404083 8/1995

(Continued)

OTHER PUBLICATIONS

"Le Carre: computer simulation to develop a new can concept." A. Zarraoa et al., Contact Mechanics 2001.*

*Primary Examiner*—Stephen F. Gerrity
(74) *Attorney, Agent, or Firm*—Stevens, Davis, Miller & Mosher, LLP

(57) ABSTRACT

Method for providing a heat treated filled and closed can, including the consecutive steps of: filling a metal cup, closing the metal cup with a lid making a gas tight heat treatable can, heat treating the can, wherein measures are taken to achieve an under-pressure in the can after closing the cup and wherein the can is chosen that is either of a flexible type on the one hand or of a rigid type with increased strength provided with a seal on lid on the other hand. The measures comprise a step belonging to the group of steps consisting of: using a partly frozen filling; having the filling include constituents that interact after closing so as to lower the specific volume of the filling in the can; adding steam to the cup after filling and before closing; closing the cup under sub-atmospheric pressure; and partly evacuating the can after closing.

17 Claims, 2 Drawing Sheets

U.S. PATENT DOCUMENTS 2,676,891 A * 4/1954 Wilbur ..... 426/407
3,050,403 A * 8/1962 Erickson ..... 426/393
3,406,080 A * 10/1968 Gibble ..... 426/393
4,717,575 A * 1/1988 Larroche ..... 426/402
4,919,955 A 4/1990 Mitchell
4,967,538 A 11/1990 Leftault, Jr. et al.
5,054,265 A * 10/1991 Perigo et al. ..... 53/425
5,100,017 A * 3/1992 Ishinabe et al. ..... 220/669
5,125,528 A 6/1992 Heyn et al.
5,328,045 A * 7/1994 Yoshida ..... 220/359.2
5,457,939 A * 10/1995 Bardou et al. ..... 53/432
5,804,237 A 9/1998 Diamond et al.
5,958,487 A 9/1999 Emberger et al.
6,213,337 B1 4/2001 Kamperman et al.

FOREIGN PATENT DOCUMENTS

EP 1005428 6/2000
GB 2266218 10/1993
WO 9908940 2/1999

* cited by examiner

METHOD FOR PROVIDING A HEAT TREATED FILLED AND CLOSED METAL CAN

This application is a §371 National Stage Application of International Application No. PCT/EP2003/006903, filed on 27 Jun. 2003, claiming the priority of European Patent Application No. 02077594.6 filed on 28 Jun. 2002.

The invention relates to a method for providing a heat treated filled and closed metal can.

A heat treated filled and closed metal can will usually contain a food for humans or animals, which food is or is to be heat-treated in the closed metal packaging after filling. The heat treatment the food undergoes is in principle related to the type of food, and may further vary per recipe and producer.

The metal of the can is usually steel or aluminium. In the steel and aluminium industry as well as in the packaging industry and in the food industry it is continuously sought to improve the packaging e.g. regarding the amount of material consumed when producing a can, or the amount of material which can be recycled or the appearance of a can to the consumer.

An example of the achievements of continuous innovation is a can according to the Le Carré® concept, which is a multi-panel type of can having flat shell parts, as disclosed in e.g. EP 1005428 entitled "metal body for packaging purposes, for example a food can".

According to EP 1005428, by providing a flexible can it is possible to work a method for heat treating, for example sterilising a filled can in an autoclave, whereby the can needs to be handled far less critically in terms of pressure. In practice this means that the pressure control of the autoclave is far easier to achieve. As long as the pressure in the autoclave is higher than the pressure in the can nothing can go wrong.

Although the concept of Le Carré® as set out above was very promising there is a problem that it is not always economically attractive to perform heat treatment in autoclaves albeit under flexible conditions. Commercial sterilisation autoclaves operate batch-wise and batch processes are not economically attractive for all food stuffs in the food packagings under consideration.

Further, there is a need to find better solutions for accessibility of canned food stuff by providing more easily opening closures and it is known that such closures because of their easy opening characteristics will be more vulnerable to—even quite low-internal over-pressure situations, especially when such an over-pressure situation is combined with high temperature, like a sterilisation temperature of 120° C. or more, and time, e.g. during a sterilisation period of half an hour or more. In the present document, the term over-pressure denotes a pressure in the closed can that is higher than the pressure outside the closed can. Similarly the term under-pressure denotes a pressure in the closed can that is lower than the pressure outside the closed can.

This problem is now overcome or reduced substantially by the first embodiment of the invention defined as a method for providing a heat treated filled and closed can, comprising the consecutive steps of:

filling a metal cup, closing the metal cup with a lid making a gas tight heat treatable can, heat treating the can, wherein measures are taken to achieve an under-pressure in the can after closing the cup characterised in that the can is of a flexible type.

The measures comprise a step belonging to the group of steps consisting of:

using a partly frozen filling;

having the filling comprise constituents that interact after closing so as to lower the specific volume of the filling in the can;

adding steam to the cup after filling and before closing;

closing the cup under sub-atmospheric pressure;

partly evacuating the can after closing;

The term flexible denotes that the volume the closed and filled can occupies increases substantially if there is only a slight over-pressure in the can and decreases substantially if there is only a slight under-pressure in the can.

By choosing in this method a can with this feature of flexibility, by shifting from a pressure orientated approach to a volume orientated approach advantages are achievable as will elucidated further hereafter.

In this context the filling comprise constituents that interact after closing so as to lower the specific volume of the filling in the can means for example having the filling comprise constituents that after the cup is closed react so as to form a reaction product that occupies a lower volume than that of the original constituents, and this independently of the effect temperature has on volume.

In an embodiment of the method according to the invention wherein a can is chosen that is of a flexible type, the can is closed with a lid of the easy pull off seal on type adhered by a sealant to the metal cup. According to the invention it is now possible to use such a very easily openable but over-pressure sensitive lid in spite of the heat treatment that would by industry prejudice necessarily cause over-pressure which would lead to failure of such over-pressure sensitive seal on type lid.

In preferred embodiments a can is chosen that is of a flexible type that has a flexibility of more than or equal to 25, preferably 35, the flexibility being quantitatively defined in detail hereafter. By choosing a can that has a flexibility of a considerably higher value than conventional heat treatable cans, the risk of too high an over-pressure as well as of too high an under-pressure is considerably reduced.

In a preferred embodiment a can is chosen that is of a flexible type capable of surviving a volume reduction of more than 7.5%, preferably more than 10% or even 15% without collapsing. By choosing such a can the risk of collapse in an extreme under-pressure situation is minimised.

The invention is also embodied in a method, wherein a cup is chosen that comprises an essentially flat wall panel. Such a cup is flexible because of the mechanical properties inherent in an essentially flat panel forming part of a body, in this ease the cup.

The aforementioned problem is also overcome or reduced substantially by the second embodiment of the invention defined as a method for providing a heat treated filled and closed can, comprising the consecutive steps of:

filling a metal cup, closing the metal cup with a lid making a gas tight heat treatable can, heat treating the can, wherein measures are taken to achieve an under-pressure in the can after closing the cup characterised in that the can is of a rigid type and that the can comprises a lid of the easy pull off type adhered to the metal cup, the measures being of the kind mentioned above.

The term rigid denotes that the volume the closed and filled can occupies does not change substantially if there is even a substantial over-pressure in the can and vice versa.

By choosing in this method a can with this feature of rigidity, by shifting in a pressure orientated approach the internal under-pressure to a higher absolute values, thus lowering the maximum internal over-pressure, it is now possible to use a "seal on" can lid, provided that the rigid can is made strong enough to bear the increased internal under-pressure as will elucidated further hereafter.

BRIEF DRAWING DESCRIPTIONS

DETAILED DESCRIPTION OF INVENTION

Figure 1:
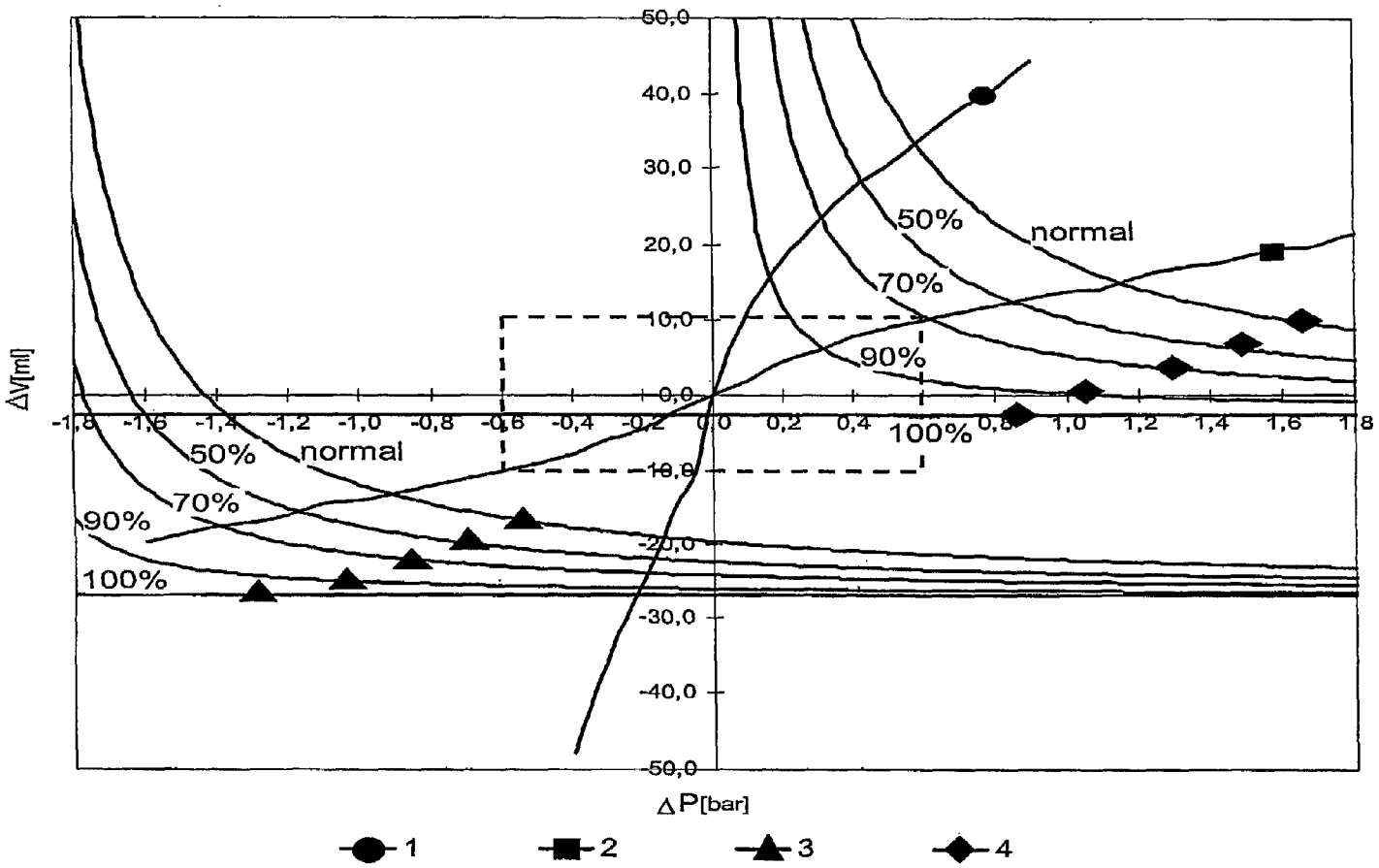
FIG. 1 is a graph showing ΔP–ΔV with homogenous temperature T.

FIG. 1 is a graph of ΔP–ΔV with homogeneous temperature T, and shows the performance of a Le Carré® fitted with a lid of the easy pull off type (EPOL) and a reference can during sterilisation with varying degrees of vacuum filling achieved by adding steam to the cup of the can before closing. The line denoted '1' represents Le Carré®, the line denoted '2' represents the reference can, the line denoted '3' represents the upper boundaries and the line denoted '4' represents the lower boundaries explained hereinafter.

The vertical axis denotes the volume change ΔV in ml of the can and the horizontal axis denotes the pressure difference ΔP over the can in bar. The ΔP–ΔV measurements are performed by pumping a fluidum, in this case water, into an already filled can (over-pressure situation) or pumping water out of a filled can (under-pressure situation). The pressure and volume changes are measured as the water is pumped in or out.

Figure 2:
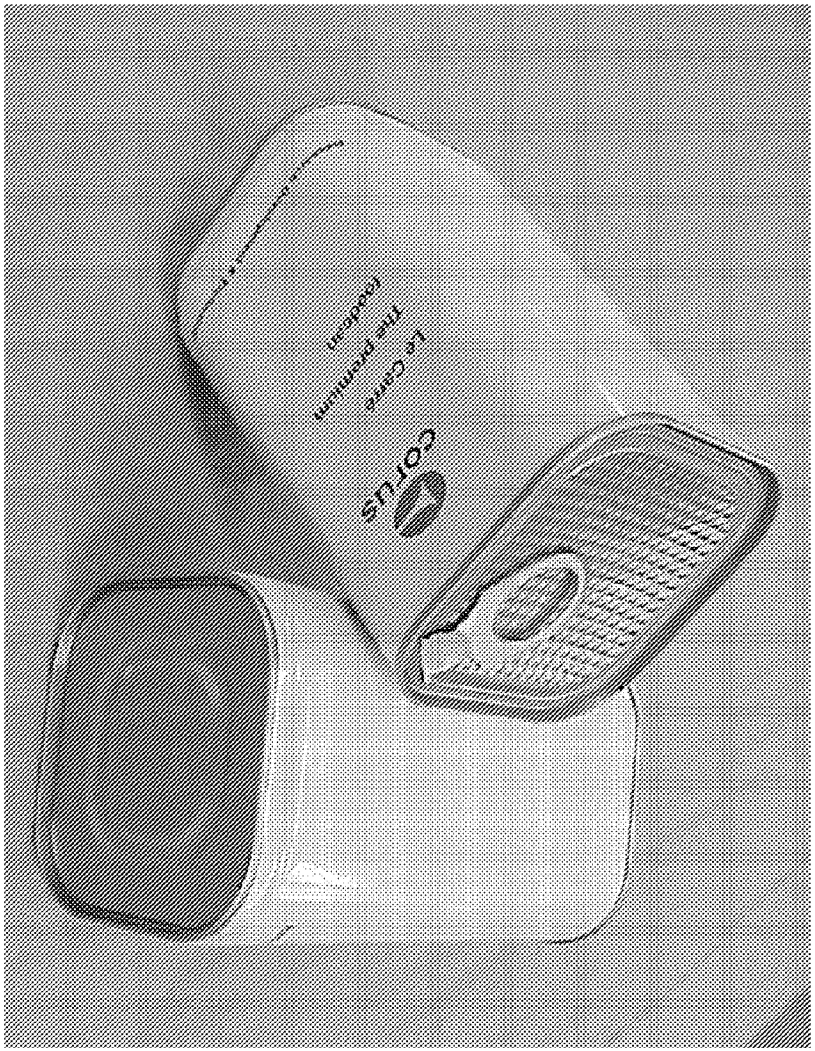
Fig. 2 (PRIOR ART)
FIG. 2 shows a photograph of prior art LE CARRÉ cans filled and sealed according to the prior art; cans according to the present invention may be LE CARRÉ cans, if their preparation is changed to include the method of the present invention, but are not limited to LE CARRÉ cans.

In FIG. 1 the flexibility line denoted "Le Carré®" (wall 0.13 mm, bottom 0.17 mm, EPOL 0.17 mm) extends from the lower left quadrant into the upper right quadrant and the gradient of the line represents the flexibility of the Le Carré® can, of which can a photographic representation is shown in FIG. 2. The flexibility line denoted "reference can" also extends from the lower left quadrant into the upper right quadrant and the gradient of the line represents the flexibility of a round reference can (diameter 73 mm, 0.14 mm 3 piece steel can with conventional 0.196 mm ends, maximum contents 414 ml at ambient conditions). Defining flexibility as the gradient $$\frac{\Delta V}{\Delta P}$$

of the flexibility line in the interval between ΔV=−10 ml and ΔV=10 ml the Le Carré® can has a flexibility of approximately 154 which is about nine times greater than the reference can which has a flexibility of approximately 17.

For completeness it is remarked that to be able to compare the flexibility of different containers, in case a container with a different content would have to be tested, for example a container with a maximum content of 500 ml at ambient conditions, the interval to be used to calculate the flexibility will be 500/414*10 which is approx. 12 ml.

The upper and lower boundaries represent the extreme process conditions the can may be subjected to during the sterilisation process. The upper boundaries are based on a sterilisation process with a sterilisation temperature of 121° C. and a counter pressure of 2 bar, the lower boundaries are based on conditions where the temperature is 20° C. and the counter pressure is also 2 bar.

The specific boundary conditions illustrated in FIG. 1 apply to placing a filling at a temperature of 60° C. in an cylindrical test vessel with a content of also 414 ml, leaving 5% headspace above the filling and applying pressure to the contents of the test vessel (i.e. to both the filling and contents of the headspace) via a piston. The external pressure applied to the test vessel was 2 bar. The pressure and volume changes across the test vessel were measured with the system at a lower temperature of 20° C. and an upper temperature of 121° C.

The "normal" boundary represents the situation where there is no steam supplied to the can cup before closing. However, as the temperature of the filling is 60° C., approximately 20% of the air in the headspace will be replaced. The remaining upper and lower boundary conditions are marked with percentages that indicate the percentage of air deliberately replaced by adding steam into the headspace. Such partial or whole vacuum filling results in the can having to withstand less over-pressure during sterilisation.

According to the invention, the over-pressure may be reduced by adding steam to the cup after filling and before closing but the same effect can according to the invention also be obtained by using a partly frozen filling, having the filling comprise constituents that interact after closing so as to lower the specific volume of the filling in the can, closing the cup under sub-atmospheric pressure and partly evacuating the can after closing.

From FIG. 1 it can clearly be seen that replacing e.g. 50% of the air in the headspace with steam reduces the over-pressure in the hot state as well as increases the under-pressure in the cold state.

Reducing, or even completely avoiding, over-pressure in the can during the sterilisation process enables the can to be sealed with a seal on lid, e.g. an easy pull off lid (EPOL), e.g. an EPOL made of ultra-thin polymer coated packaging steel, without risking failure of the lid. A lid such as an EPOL can be particularly sensitive to over-pressure and thus may give a risk of failing during a conventional sterilisation procedure. One method of improving the survival rate of cans fitted with EPOLs is applying a carefully controlled sufficient external counter pressure during the sterilisation process to reduce or compensate the over-pressure experienced by the can.

The present invention achieves the same result without requiring the application of such counter pressure. In conventional continuous sterilisation processes, e.g. the hydrostatic process, the way of supplying additional counter pressure is by adding more stages to the installation, which is complicated and expensive. The method of the first embodiment of the present invention thus makes it possible to sterilise large amounts of flexible type cans having a flexibility of e.g. more than 25 in a continuous hydrostatic sterilisation process without requiring expensive additional stages to be included in the installation. The method of the second embodiment of the present invention thus makes it possible to sterilise large amounts of rigid cans having increased strength and a flexibility of e.g. less than 20 and fitted with an easy pull off lid in a continuous hydrostatic sterilisation process without requiring expensive additional stages to be included in the installation.

As can be seen from the lower process boundaries, the lowering of the over-pressure in the can however, also increases the under-pressure in the can. The "normal" boundary line shows less severe under-pressure conditions than those obtained when 50–100% of the air in the headspace is replaced. To overcome this the method of the first embodiment of the present invention uses a flexible can, able to withstand the increased under-pressure.

The method of the second embodiment uses a can of a rigid type with increased strength fitted with an EPOL lid.

It is remarked that a steam filled rigid round can (diameter approx. 85 mm, height approx. 85 mm, made from aluminium thickness 0.24 mm) fitted with a conventional seamed full aperture easy open lid is known. Such a can is in the market for packaging of e.g. sweet corn. The heat treated filled and closed can according to the method of the second embodiment of the present invention however is a rigid can fitted with an easy pull off seal on lid rather than a conventional full aperture easy open lid. Thus, contrary to current industry expectation, by using the method of the present invention it is now possible to apply EPOLs in such cans and to process such cans in straightforward and large scale heat treatment processes without increased risk of failure.

From FIG. 1 it can be seen that the Le Carré® can flexibility line crosses through and extends beyond the lower boundaries of the process conditions. The Le Carré® can provided according to the method of the invention will thus not fail even under the most extreme conceivable conditions. The reference can flexibility line however, does not extend to or cross all the lower boundary lines. The reference can is not strong and rigid enough or flexible enough to withstand extreme under-pressure and fails.

The method of embodiment one of the present invention using a flexible can thus enables such cans to be sterilised without counter pressure even when fitted with over-pressure sensitive lids such as EPOLs.

Experiments have shown that the flexible Le Carré® can is best able to withstand under-pressure if the headspace is relatively small, e.g. less than 8%.

It is remarked that the rigid can is best able to withstand under-pressure if the headspace is relatively large, e.g. more than 5%.

Although the method has been described in detail with reference to Le Carré® it is clear that the method could be used successfully for other heat treated, filled and closed flexible cans or idem rigid cans of increased strength fitted with lids vulnerable to over-pressure.

The invention claimed is:

1. Method for providing a heat treated filled and closed can, comprising the consecutive steps of:

filling a metal cup of the flexible type with a filling;

closing the metal cup with a lid making a gas tight heat treatable can;

taking measures achieving an under-pressure in the can after closing, wherein the can is sufficiently full to avoid collapse at the under-pressure; and heat treating the filled and closed can, wherein the filled and closed can permits volumetric altering of the can internal volume to maintain a pressure in the filled and closed can to avoid rupture of the can during heat treating.

2. Method according to claim 1, wherein the can is closed with a lid of the easy pull off seal on type adhered by a sealant to the metal cup.

3. Method according to claim 1, wherein the can has a flexibility of at least about 35 mL/bar, measured as the gradient $\Delta V/\Delta P$ of the flexibility line in the interval between $\Delta V=-10$ mL and $\Delta V=10$ mL.

4. Method according to claim 1, wherein the can is of a flexible type capable of surviving a volume reduction of more than 7.5% without collapsing.

5. Method according to claim 1, wherein the cup comprises a substantially flat wall panel.

6. Method according to claim 1, wherein the can is of a flexible type capable of surviving a volume reduction of more than 10% without collapsing.

7. Method according to claim 1, wherein the can is of a flexible type capable of surviving a volume reduction of more than 15% without collapsing.

8. Method according to claim 1, wherein the measures comprise at least one step belonging to the group of steps consisting of:

using a partly frozen filling;

having the filling include constituents that interact after closing so as to lower the specific volume of the filling in the can;

adding steam to the cup after filling and before closing;

closing the cup under sub-atmospheric pressure; and partly evacuating the can after closing.

9. Method according to claim 1, wherein the measures comprise at least one step belonging to the group of steps consisting of:

having the filling include constituents that interact after closing to lower the specific volume of the filling in the can;

adding steam to the cup after filling and before closing;

closing the cup under sub-atmospheric pressure; and partly evacuating the can after closing.

10. Method according to claim 1, wherein the measures comprise at least one step belonging to the group of steps consisting of:

having the filling include constituents that interact after closing to lower the specific volume of the filling in the can; and adding steam to the cup after filling and before closing.

11. Method according to claim 1, wherein the measures comprise at least one step belonging to the group of steps consisting of:

closing the cup under sub-atmospheric pressure; and partly evacuating the can after closing.

12. Method according to claim 1, wherein the can has a flexibility of at least about 25 mL/bar, measured as the gradient $\Delta V/\Delta P$ of the flexibility line in the interval between $\Delta V=-10$ mL and $\Delta V=10$ mL.

13. Method for providing a heat treated filled and closed can, comprising the consecutive steps of:

filling a metal cup of the rigid type with a filling;

closing the metal cup with a flexible lid of the easy pull off type adhered to the metal cup making a gas tight heat treatable can;

taking measures achieving an under-pressure in the can after closing, wherein the can is sufficiently full to avoid collapse at the under-pressure; and heat treating the filled and closed can, wherein the filled and closed can permits volumetric altering of the can internal volume to maintain a pressure in the filled and closed can to avoid rupture of the can during heat treating.

14. Method according to claim 13, wherein the measures comprise at least one step belonging to the group of steps consisting of:

using a partly frozen filling;

having the filling include constituents that interact after closing so as to lower the specific volume of the filling in the can;

adding steam to the cup after filling and before closing;

closing the cup under sub-atmospheric pressure; and partly evacuating the can after closing.

15. Method according to claim 13, wherein the measures comprise at least one step belonging to the group of steps consisting of:

having the filling include constituents that interact after closing to lower the specific volume of the filling in the can;

adding steam to the cup after filling and before closing;

closing the cup under sub-atmospheric pressure; and partly evacuating the can after closing.

16. Method according to claim 13, wherein the measures comprise at least one step belonging to the group of steps consisting of:

having the filling include constituents that interact after closing to lower the specific volume of the filling in the can; and adding steam to the cup after filling and before closing.

17. Method according to claim 13, wherein the measures comprise at least one step belonging to the group of steps consisting of:

closing the cup under sub-atmospheric pressure; and partly evacuating the can after closing.

* * * * *